US005449176A

United States Patent [19]

Schwab, Jr.

[11] Patent Number: 5,449,176

[45] Date of Patent: Sep. 12, 1995

[54] GOLF TRAINING DEVICE

[76] Inventor: Paul E. Schwab, Jr., 1656 Bahia Vista Way, La Jolla, Calif. 92037

[21] Appl. No.: 338,833

[22] Filed: Nov. 10, 1994

Related U.S. Application Data

[63] Continuation-in-part of Ser. No. 208,858, Mar. 11, 1994, abandoned.

[51] Int. Cl.[6] ..... A63B 69/36

[52] U.S. Cl. ..... 273/187.6; 63/20

[58] Field of Search ..... 273/177 R, 177 A, 177 B, 273/178 R, 178 A, 178 B, 32 A, 187.6; 63/20

[56] References Cited

U.S. PATENT DOCUMENTS

| | | | |
|---|---|---|---|
| 686,197 | 11/1901 | Bippart | 63/20 |
| 898,530 | 9/1908 | Treadwell | 273/177 A |
| 1,596,110 | 8/1925 | Lynch | 273/187.1 |
| 3,622,159 | 11/1971 | Morton | 273/187.6 |
| 3,992,011 | 11/1976 | Jessee | 273/187.1 |
| 4,150,826 | 4/1979 | Baldorossi et al. | 273/199 R X |
| 4,475,676 | 10/1984 | Smith | 273/32 A X |
| 4,521,018 | 6/1985 | Cotchonis | 273/32 A |
| 4,940,238 | 7/1990 | Bradley | 273/199 R |

*Primary Examiner*—George J. Marlo
*Attorney, Agent, or Firm*—Stevens, Davis, Miller & Mosher

[57] ABSTRACT

A golf training device comprising a thin plate having at least one protuberance extending therefrom, the plate having a crescent shape which has a length less than the diameter of a golf ball and will fit within a horizontal projection of a golf ball on the ground without touching a golf ball within the projection.

4 Claims, 1 Drawing Sheet

GOLF TRAINING DEVICE

This application is a Continuation-in-Part of application Ser. No. 08/208,858, filed Mar. 11, 1994, now abandoned.

BACKGROUND OF THE INVENTION

FIELD OF THE INVENTION

This invention relates to a golf practice device to assist the golfer in keeping his concentration focused during the striking of the ball. The device is employed primarily on the green but may be used on the tee or fairway.

One of the basic criticisms given to a golfer when he has mishit a ball is that during the course of the stroke he has failed to keep his head down. This criticism applies to putting, teeing off, or making fairway shots. The golfer without concentration tends to turn his head to follow the flight of the ball and as a result is not looking at the ball at the time the club contacts the ball.

There have been numerous devices developed to aid the golfer with this problem referred to as "peeking".

Tees have been developed with arrows radially extending from the tee to permit the golfer to line up his stance properly prior to hitting the ball. Such tees have a colored area thereon for holding the golfer's concentration to a particular area of the ball. However, tees are not permitted on the greens or fairways so that only one portion of the golfer's game can be benefitted by such a tee.

Tees also are known which have a light thereon so that after the golfer has struck the ball he observes the light as the ball leaves the tee and the club passes over the tee indicating that his head, shoulders and eyes were properly oriented during the swing.

Heretofore, there is no known device which will benefit a golfer's game off the tee, on the fairway and on the green.

It is therefore an object of the invention to provide a practice device to aid the golfer's concentration in striking the ball whether the ball is on the tee, fairway or green.

A further object is to provide such a practice device cheaply so that it can be used by the entire golfing public.

Another object is to provide a practice device of such a size that it can easily be carried in the golfer's pocket.

The present invention is constituted of a colored crescent shaped plate device which in use does not touch the ball but fits under the ball while the ball is on the tee, fairway or green and is unseen by the golfer until after the ball is stroked. The plate may contain at most two protrusions for fixing the device to the ground. The device may be molded from a plastic material such as polyethylene, polystyrene or polyurethane or made of metal. The color of the device should be one which catches the eye, e.g. yellow, but may be of any color which contrasts with the ground from which the ball is being struck.

The golf ball under which the device is applied conforms to United States Golf Association and the Royal and Ancient Golf Club of St. Andrews Rules which state that the weight of the ball shall not be greater than 1.620 ounces and the diameter of the ball shall not be less than 1.680 inches.

The positioning of the device while the ball is teed up is easy because of the space between the ball and the ground. However, when the ball is to be in contact with the ground upon being stroked, it is necessary to pick up the ball before positioning the device. If it is desired to position the device without being required to move the ball, it is necessary that the device have a hand holdable extension which permits the golfer to position the device beneath the horizontal projection of the ball without having the device come into contact with the ball. The extension is of a color compatible with the surface upon which the ball is resting.

Other details and features of the invention will stand out from the description given below by way of non-limitative example and with reference to the accompanying drawings, in which:

DESCRIPTION OF THE PREFERRED EMBODIMENTS

Figure 1:
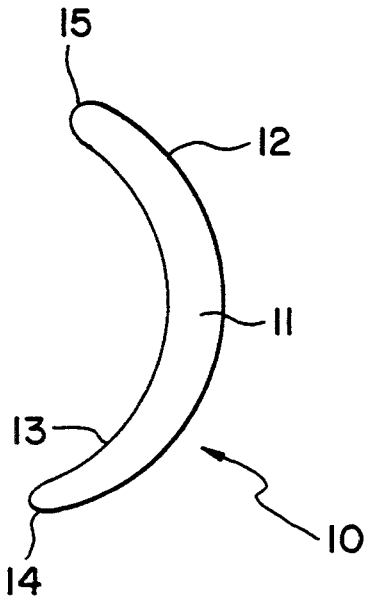
FIG. 1 is a plan view of the invention.
Figure 4:
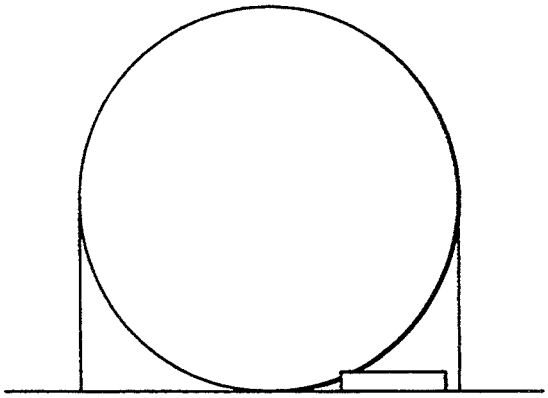
FIG. 4 shows the invention placed within a horizontal projection of a golf ball.
Figure 2:
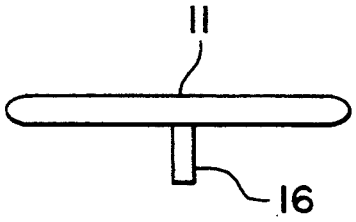
FIG. 2 is a vertical front view of one embodiment of the invention.
Figure 3:
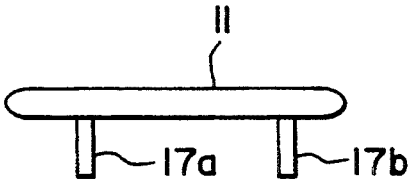
FIG. 3 is a vertical front view of a further embodiment of the invention.

Referring to the drawings, FIG. 1 shows a top plan view of the device 10. The device 10 is constituted of a crescent-shaped thin plate 11 having a convex edge 12 and a concave edge 13 which edges come together to form ends 14 and 15. Depending from the bottom of plate 11 is at least one protuberance 16 (FIG. 2) which permits positioning of the plate 11 into the ground. Protrusion 16 is centrally positioned with respect to the plate 11. When the plate 11 is properly positioned it is placed under the ball without touching the ball so that the golfer looking from above while in a ball-hitting stance cannot see the device. After the ball is stroked the golfer should see the device which means that he has kept his eyes on the ball during stroking. FIG. 3 shows an embodiment where two protuberances 17*a*, 17*b* extend from the bottom of plate 11. The device is of a length less than the diameter of a golf ball and of a thickness to permit the device to be placed within a horizontal projection of the golf ball.

Figure 5:
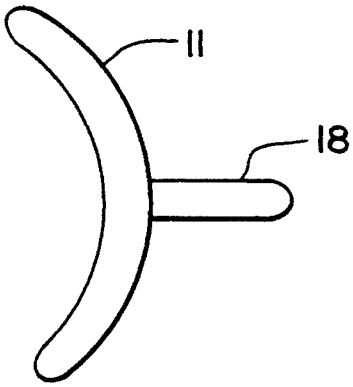
FIG. 5 is a plan view of a further embodiment of the invention.
Figure 6:
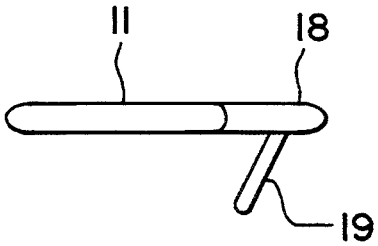
FIG. 6 is a vertical side view of the embodiment shown in FIG. 5.

In FIG. 5 a further embodiment is shown in which the plate 11 has a handle 18. The handle 18 permits the golfer to position the device without moving the ball whether the ball is on the tee, fairway, or green although such an extension is not needed when the ball is teed up. In FIG. 6 a protuberance 19 extends from the handle 18 at an angle toward said device so that as the device is stably positioned on the ground, the device slides beneath the ball. A horizontal projection of protuberance 19 is equal to the width of the plate 11 at the point of attachment of handle 18.

While the principles of the invention have now been made clear in the illustrated embodiments, there will be immediately obvious to those skilled in the art, many modifications of structures, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A golf training device comprising a thin plate having at most two protuberances extending from a single side thereof, for insertion into the ground, said plate having a crescent shape which has a length less than the diameter of a conventional regulation size golf ball which has a diameter of 1.68 inches or slightly greater than 1.68 inches and a weight of not greater than 1.62 ounces, said plate being capable of being placed on the ground within a horizontal projection of said golf ball on the ground so that a golfer looking from above while in a ball hitting stance cannot see the device.

2. The golf training device of claim 1 colored yellow.

3. The golf training device of claim 1 wherein said two protuberance extend at a right angle to said plate.

4. The golf training device of claim 1 wherein said plate defines a convex side having ends and an elongated extension, said extension extending outwardly from said convex side intermediate its ends.

* * * * *